US010641035B1

(12) United States Patent
Weber et al.

(10) Patent No.: US 10,641,035 B1
(45) Date of Patent: May 5, 2020

(54) GLAZING SYSTEM FOR HIGH WIND AREA

(71) Applicant: Hawkes Design and Consulting, LLC, Charleston, SC (US)

(72) Inventors: Bruce A. Weber, Summerville, SC (US); Henry M. Hay, Charleston, SC (US)

(73) Assignee: Hawkes Design and Consulting, LLC, Charleston, SC (US)

( * ) Notice: Subject to any disclaimer, the term of this patent is extended or adjusted under 35 U.S.C. 154(b) by 259 days.

(21) Appl. No.: 15/414,151

(22) Filed: Jan. 24, 2017

Related U.S. Application Data

(60) Provisional application No. 62/286,653, filed on Jan. 25, 2016.

(51) Int. Cl.

| | |
|---|---|
| ***E06B 3/30*** | (2006.01) |
| ***E06B 5/12*** | (2006.01) |
| ***E06B 7/22*** | (2006.01) |
| ***E06B 3/28*** | (2006.01) |

(52) U.S. Cl.
CPC ..... *E06B 5/12* (2013.01); *E06B 3/28* (2013.01); *E06B 3/30* (2013.01); *E06B 7/22* (2013.01)

(58) Field of Classification Search
CPC ... E06B 5/12; E06B 5/00; E06B 5/003; E06B 2003/74476; E06B 3/30; E06B 3/28; E06B 3/26; E06B 3/2605; E06B 3/273; E06B 3/2735; E06B 3/308; E06B 3/54; E06B 3/5418; E06B 3/64; E06B 3/66; E06B 7/28
See application file for complete search history.

(56) References Cited

U.S. PATENT DOCUMENTS

| | | | | |
|---|---|---|---|---|
| 3,452,636 | A * | 7/1969 | Cohen | F16B 43/001 277/640 |
| 5,546,713 | A * | 8/1996 | Voegele, Jr. | E04D 3/08 52/202 |
| 5,577,355 | A * | 11/1996 | Leonelli | E06B 3/5892 52/204.591 |
| 5,780,149 | A * | 7/1998 | McCurdy | B32B 17/06 428/336 |
| 6,151,849 | A * | 11/2000 | Twigg | E06B 3/5892 52/204.53 |
| 8,196,363 | B2 | 6/2012 | Hay et al. | |
| 8,438,802 | B1 | 5/2013 | Hay et al. | |
| 8,789,324 | B2 | 7/2014 | Hay et al. | |
| 8,863,452 | B1 * | 10/2014 | Hay | E06B 5/10 49/463 |
| 2009/0241421 | A1 | 10/2009 | Hay, III et al. | |

(Continued)

*Primary Examiner* — Jessica L Laux
(74) *Attorney, Agent, or Firm* — Nexsen Pruet, LLC; Michael A. Mann

(57) ABSTRACT

A glazing system that facilitates protecting windows from damage caused by high winds. The glazing system, for use with windows in doors, transoms, and in windows adjacent to doorways is an extruded polymeric frame that surrounds and supports and seals the window in place. The frame includes a stacked screw boss accessible from the exterior after removing a lineal cap. The screw boss receives screws use to hold a panel in place over the window during high winds to protect the window and which panel may be easily and quickly removed when the high winds pass. The interior side of the frame also has a screw path usable for attaching brackets for blinds to the back of the frame.

11 Claims, 3 Drawing Sheets

(56) References Cited

U.S. PATENT DOCUMENTS

| | | | |
|---|---|---|---|
| 2009/0277108 | A1 | 11/2009 | Hay, III et al. |
| 2010/0186641 | A1 | 7/2010 | Hay, III et al. |
| 2014/0326126 | A1 | 11/2014 | Hay, III et al. |

* cited by examiner

GLAZING SYSTEM FOR HIGH WIND AREA

TECHNOLOGY FIELD

The technological field of the disclosure is glazing. In particular, the technology field is glazing for windows in doors, beside doors as in sidelights and above doors as in transoms.

BACKGROUND

In areas of the world that are subject to occasional high winds, such as occur during storms and hurricanes, exterior windows may be subjected to impact damage from debris and sand. If there is a warning that weather is bringing high winds through such an area, measures may be taken to avoid damage, for example, by boarding up the windows.

The preventive measure of boarding up windows may also be applied to the smaller windows in exterior doors or to transoms over doors or to side lights, which are windows in the walls close to the doors. Applying wooden boards over these windows presents unsatisfactory choices, namely, whether to apply a board over the entire door, including side lights and transom window, which prevents the door from being opened or to drive nails and screws into the door to secure smaller boards over just the area occupied by the window. Custom-made window covers are another option if the homeowner or business owner has the foresight to have them made in advance and the willingness to go to the extra expense.

A better way to protect glazing of doors, transoms, and door surrounds that is simple, inexpensive, and quick and easy to use would be advantageous.

SUMMARY

This disclosure presents a glazing system that facilitates protection of windows from damage caused by high winds. The glazing system is intended for use with windows in doors, in transoms over doorways, and in sidelights adjacent to doorways. In these applications, the structure that surrounds the window pane is a frame supporting and holding it to a support such as the door or the home's exterior wall.

An aspect of the disclosure is a frame that includes a screw boss concealed behind a lineal cap. The screw boss may be a stacked screw boss, having several chambers with walls defining each chamber and resisting the pull of a screw inserted into the screw boss. When the cap is removed, the screw boss can be accessed and used to receive and hold screws for fastening a panel over the frame in order to protect the window pane. The panel fastened in place may protect the window from damage. After the panel and screws that hold it are removed, the cap can be re-installed over the screw boss, or, alternatively, the screws can be left in place, driven deep enough into the frame so that the tops of the screws do not prevent the cap from being re-installed over the screw boss. The frame in effect then also acts as a place to store the screws when not in use. It also keeps the interior of the screw boss cleaner.

Another aspect of the disclosure is that the frame serves to hold the pane to the support for it, which can be a door or wall framing. The frame has a pane-receiving side and an opposing, support-receiving side, with ledges on each side. On the pane-receiving side, the back of the window is against a first ledge; on the support-receiving side, the front of the support is against a second ledge. The screw boss runs between the pane and the support with its entrance on the exterior of the frame. The cap frictionally fits to and covers the entrance to the screw boss.

Another aspect of the disclosure is a pane seal that resiliently fits against the front of the pane, against the frame itself, and runs between the frame and the first ledge on said pane-receiving side. Likewise, a support seal resiliently fits against the support and the frame to trap the support between the support seal, the frame, and the second ledge on the support-receiving side. The frame may have channels cut into it to receive a first hook integral with the pane seal and a second hook integral with the support seal to help secure the pane and the support in place.

Another aspect of the disclosure is that the support seal may be made deep enough so as to be flush with the interior or bottom side of the frame, and the frame may be provided with a screw path from the bottom so that blinds can be easily mounted on the interior of the pane using brackets fastened to the frame to cover the window, rather than to the wall adjacent to the window, for example. The pane seal may be any width that presents a pleasing appearance from the exterior.

Still another aspect of the disclosure is that the window system may also include a set of screws, washers and the lineal protective cover dimensioned for the particular window, so that the panel can be just large enough so that it covers the pane and the door remains operational. The panel maybe similar to that disclosed in U.S. Pat. No. 8,863,452 the function of which is to protect window panes. Also, the washers may be resilient on the side facing the panel and rigid on the other side to provide a rigid surface for the screw head to load when being screwed into the screw boss. Separate resilient and rigid screws may alternatively be used. The panel may be pre-drilled with holes for the screws.

Those skilled in glazing systems will appreciation other aspects of the disclosure from a careful reading of the Detailed Description, accompanied by the following drawings.

BRIEF DESCRIPTION OF THE DRAWINGS

In the figures.

DETAILED DESCRIPTION

A glazing system is a window in a door, a transom, and a door surrounds or side light. The window is made of transparent material such as glass or transparent plastic and may have a plastic coating on it such as that disclosed in US2014/0326126. The term support will be used herein to refer to the door and to the wall that supports, or holds, the glazing in place indirectly. The glazing or pane is directly supported by the present frame which is held in place by the support.

Figure 1:
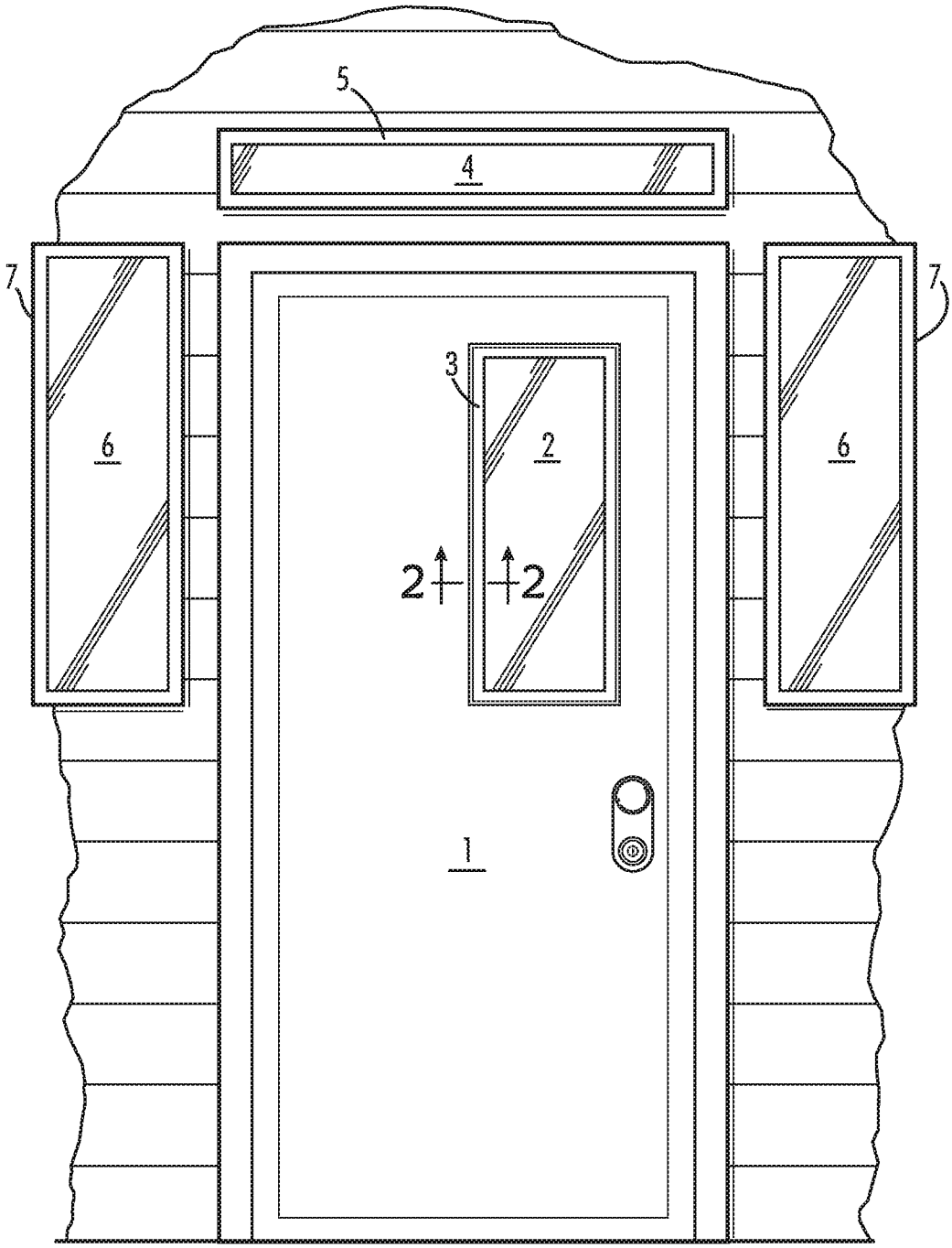
FIG. 1 is front view of a door with a window, a transom above the door, and side lights located lateral to the door.

Referring to the figures, FIG. 1 shows a door 1 and adjacent surfaces. Door 1 has a window 2 with a frame 3 surrounding it. Above door is a transom window 4 with frame 5, and adjacent to door 1 are two side windows 6 having frames 7. Window 2, transom window 4, and side windows 6 may each be covered with a panel, as described herein, which is secured with screws and washers to frames 3, 5, and 7, respectively.

Figure 2:
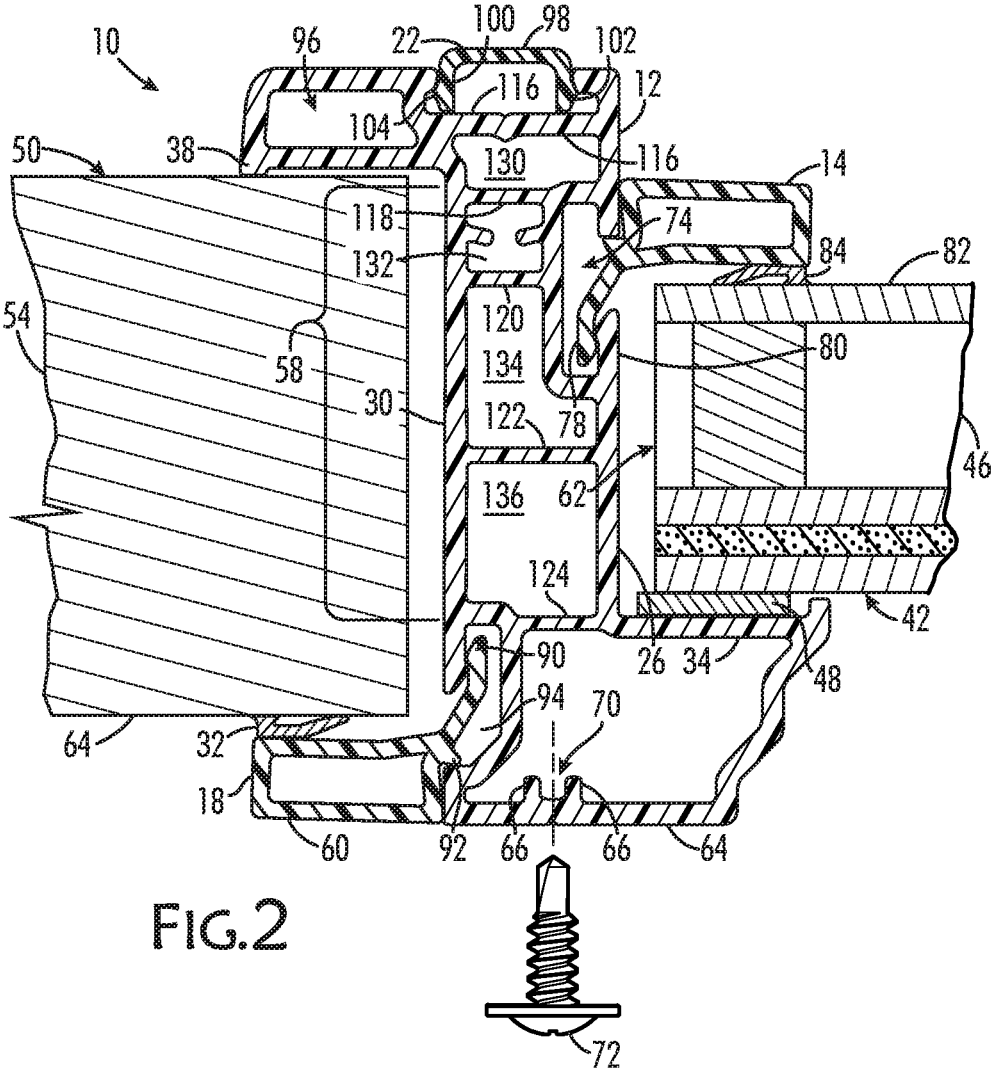
FIG. 2 is a cross-sectional view of the frame for a window in a door, a transom or a side light, according to an aspect of the disclosure.

FIG. 2 shows a cross section taken along lines 2-2 of FIG. 1 of a glazing system 10. Glazing system 10 includes a frame 12, a pane seal 14, a support seal 18, and a cap 22. Frame 12 may be an extruded, lineal profile, made of plastic such as vinyl, or of aluminum. Frame 12 has internal structure, to be described below, that provides support for a pane 46 to be carried, particularly if frame 12 is made of vinyl.

Frame 12 has a pane-receiving side 26 and a support-receiving side 30. On pane-receiving side 26 is a first ledge 34 and there is a second ledge 38 on the support-receiving side 30. The back 42 of pane 46 is sealed against first ledge 34 with a tape 48, while the front 50 of support 54 is against second ledge 38. Pane seal 14 is used to hold pane 46 in place against pane-receiving side 26 of frame 12 and first ledge 34. Similarly, support seal 18 is used to hold support 54 against support-receiving side 30 of frame 12 and second ledge 38.

First ledge 34 and second ledge 38 may be integrally formed with frame 12 and screw boss 58 is formed between them.

Support seal 18 is dimensioned so that it is flush with the interior side 64 of frame 12. Also, frame 12 at interior side 64 may include walls 66 that define a screw path 70 in the event the user wants to install interior blinds (not shown). The flush face of interior side of frame 12 and of support seal 18 allow blinds (not shown) to be attached to frame 12 so they are spaced a small distance away from support 54 and extend across pane 46, to the right in FIG. 2.

Pane seal 14 fits resiliently against the exterior side 82 of pane 46 and against frame 12 to hold pane 46 between pane seal 14 and first ledge 34 on pane-receiving side 26. Frame 12 has a channel 74 running its length that receives an edge 78 of pane seal 14 therein. Channel 74 may be curved to more securely hold edge 78. For example, edge 78 may be formed in the shape of a hook as seen in FIG. 2 and channel 74 may have a curved shape that corresponds, that is, channel 74 and edge 78 may be curved. Frame 12 holds edge 78 inside channel 74 so as to take advantage of the resiliency that pane seal 14 has and its configuration, in which resilient material and curved configuration enable pane seal 14 to press resiliently against frame 10 and exterior side 82 of pane 46.

Pane seal 14, which is visible from the exterior of a structure such as a house, is functional and may be ornamental, such as would be the case if its depth, measured with respect to exterior surface 82 of pane 46 were selected to be a pleasing distance. Pane seal 14 has a pane seal extension 84 that extends away from pane seal 14 to seal resiliently against exterior side 82 of pane 46. Pane seal 14 may also have a first hook 86 that hooks into a first channel 88 formed in frame 12, as shown in FIG. 2A. Pane seal 14 together with first hook 86 and pane seal extension 84 cooperate with first ledge 34 and frame 12 to keep pane 46 in place with respect to frame 12.

Support seal 18 also fits resiliently against frame 12 and has a support seal extension 90 with a second hook 92 that hooks into a second channel 94 formed in frame 12, as shown in FIG. 2. Support seal 18, with hook 92 and support seal extension 90, thus cooperates with second ledge 38 and frame 12 to keep support 54 in place with respect to frame 12.

Figure 3:
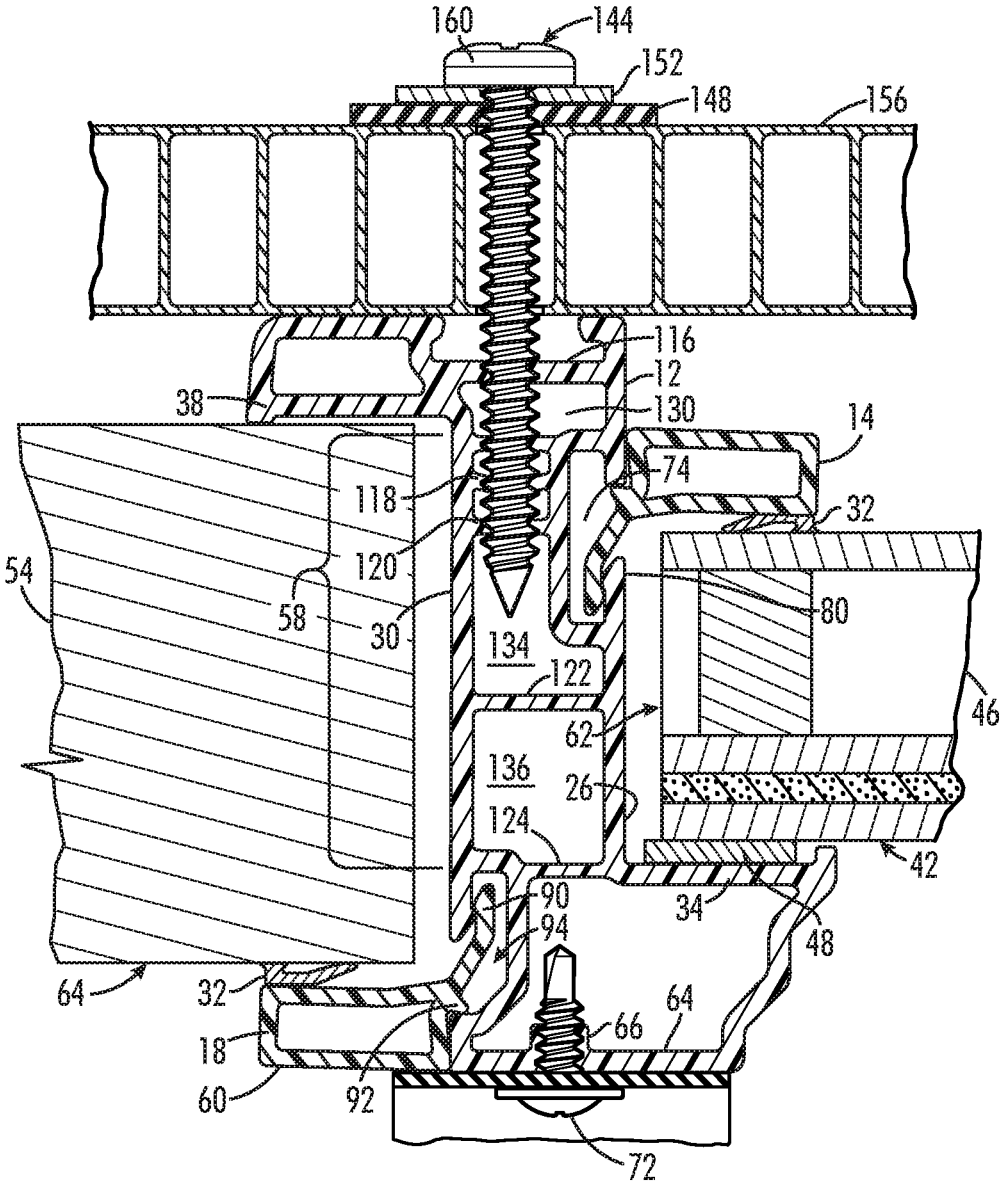
FIG. 3 shows the cross-sectional view of the frame of FIG. 2 with a panel made of hollow polymer, wood, and metal, respectively, and affixed to the frame, according to an aspect of the disclosure.

Support seal 18, being on the interior of a structure such as a house may have a depth that is selected to be functional or ornamental or both. Blinds are used to cover the interior side of a pane 46 for privacy. Accordingly, as described above, frame 12 may be operable to provide a suitable surface for supporting blinds using a screw 72 for attachment and driven through screw path 70, as best seen in FIGS. 3A, 3B, and 3C.

Cap 22, best seen in FIG. 2B, covers an entrance 94 to screw boss 58 in frame 12, and may be made of a resilient material such as extruded vinyl in order to be inserted by snapping it into entrance 94 of screw boss 58. The function of cap 22 is ornamental—in hides screw boss 58 whether a screw 72 (FIGS. 3A, 3B, 3C) is inserted or not—and functional, in that it keeps dust, dirt, and moisture out of entrance 94 and screw boss 58. Cap 22 has sides 98, 100 that carry ribs 102, 104, respectively. Screw boss 58 has grooves 108, 110, at entrance 94 that receive ribs 102, 104, respectively, to hold cap 22 securely in place.

Screw boss 58 has plural walls 116, 118, 120, 122, 124, 126, that cooperate to define chambers 130, 132, 134, 136, 138, respectively, between them to provide holding power for a screw 144. Screw 144 may be held in place by at least one washer 148. Washer 148 may be rigid to hold a panel 156 made of hollow plastic, a panel 156' made of wood, or a panel made of metal 156" (as seen in FIGS. 3A, 3B, 3C, respectively) securely over pane 46. A rigid washer 152 distributes the load of screw 144 over panel 156 and better resists higher winds. Washer 148 may also have a resilient side or, in the alternative, two washers may be used, with one resilient side 150 and one rigid side 152. A resilient side 150 deforms against panel 156 and a rigid side 152 is less likely to deform.

Long screw 144 may be stored in frame 12 when not in use by unscrewing it from screw boss 58 to remove panel 156 and washer 148 and then screwing screw 144 in screw boss 58 deeply enough for its head 160 to be seated against wall 116 so cap 22 can be snapped onto entrance 94. Washer 148 may be stored with panel 156.

What is claimed is:

1. A window system, comprising:

a. an extruded lineal profile with a pane-receiving side and an opposing, support-receiving side, wherein said pane-receiving side has a first ledge operable to receive a back of a pane against said first ledge, and wherein said support-receiving side has a second ledge operable to receive a front of a support against said second ledge, said extruded lineal profile having a screw boss formed therein between said pane-receiving side and said support-receiving side, said screw boss having an entrance and wherein said extruded lineal profile has a bottom opposite said entrance and having a screw path operable to mount interior blinds to said bottom of said extruded lineal profile;

b. a pane seal resiliently fitted against said extruded lineal profile in opposition to said first ledge and operable to hold said pane in position against said first ledge, and wherein said extruded lineal profile has a first channel formed on said pane-receiving side of said screw boss, and wherein said pane seal further comprises a first hook that extends into said first channel, said first hook of said pane seal being operable to hold said pane seal against said pane and said pane against said first ledge; and c. a support seal resiliently fitted against said extruded lineal profile in opposition to said second ledge and operable to hold said support in position against said second ledge, and wherein said extruded lineal profile has a second channel formed on said support-receiving side of said screw boss, and wherein said support seal further comprises a second hook that extends into said second channel, said second hook of said support seal being operable to hold said support seal against said support and said support against said second ledge.

2. The window system of claim 1, further comprising a cap covering said entrance to said screw boss.

3. The window system of claim 2, wherein said cap is frictionally fitted to said entrance of said screw boss.

4. The window system of claim 1, further comprising:

a. a panel;

b. a plurality of screws for holding said panel to said extruded lineal profile and over said pane-receiving side of said extruded lineal profile, and c. a plurality of washers, said plurality of screws and said plurality of washers being operable to hold said panel to said extruded lineal profile.

5. The window system of claim 1, wherein said support seal is flush with said bottom of said extruded lineal profile.

6. The window system of claim 1, further comprising a pane.

7. The window system of claim 6, wherein said pane is made of glass with a transparent coating thereon.

8. The window system of claim 1, wherein said screw boss is a stacked screw boss.

9. The window system of claim 8, wherein said stacked screw boss has at least three chambers.

10. The window system of claim 8, wherein said cap includes ribs formed therein and wherein said screw boss has an entrance with a first side and a second side opposing said first side, and wherein grooves are formed in said first side and said second side, said ribs of said cap and said grooves of said entrance being engaged when said cap is seated in said entrance of said screw boss.

11. The window system of claim 10, further comprising;

a. a panel having a plurality of holes; and b. a plurality of screws, a screw of said plurality of screws dimensioned to fit in a hole of said plurality of holes in said panel and into said stacked screw boss of said extruded lineal profile to hold said panel to said extruded lineal profile.

* * * * *